US006394006B2

(12) United States Patent
Hoekstra et al.

(10) Patent No.: US 6,394,006 B2
(45) Date of Patent: May 28, 2002

(54) GARDEN TABLE

(75) Inventors: Robert L. Hoekstra, Oviedo; Michael Mullens, Maitland; Steven F. Truntich, Orlando; Jonas R. Hedman, Orlando; Reinaldo Moraga, Orlando; Sangram Vasant Shelke, Orlando, all of FL (US)

(73) Assignee: University of Central Florida, Orlando, FL (US)

( * ) Notice: Subject to any disclaimer, the term of this patent is extended or adjusted under 35 U.S.C. 154(b) by 0 days.

(21) Appl. No.: 09/749,327

(22) Filed: Dec. 27, 2000

Related U.S. Application Data

(60) Provisional application No. 60/200,616, filed on Apr. 28, 2000.

(51) Int. Cl.[7] ..... A47B 5/00
(52) U.S. Cl. ..... 108/149; 108/26; 108/151
(58) Field of Search ..... 108/25, 26, 29, 108/149, 151, 155, 157.17, 159

(56) References Cited

U.S. PATENT DOCUMENTS

| | | | | |
|---|---|---|---|---|
| 1,201,903 | A | * | 10/1916 | Wiley |
| D90,710 | S | * | 9/1933 | Goodman |
| 1,995,943 | A | * | 3/1935 | Ritch |
| 2,615,771 | A | * | 10/1952 | Curtis |
| 2,656,045 | A | * | 10/1953 | Curtis |
| 3,606,450 | A | | 9/1971 | Sedgwick |
| 4,054,315 | A | | 10/1977 | Czarnowski |
| 4,440,096 | A | | 4/1984 | Rice |
| 4,746,021 | A | * | 5/1988 | Helmholdt et al. ..... 108/149 X |
| 5,369,805 | A | | 12/1994 | Bergsten et al. |
| 5,399,009 | A | | 3/1995 | Hiner |
| 5,421,270 | A | | 6/1995 | Kelly |
| 5,876,262 | A | | 3/1999 | Kelly |

* cited by examiner

*Primary Examiner*—Janet M. Wilkens
(74) *Attorney, Agent, or Firm*—Brian S. Steinberger; Law Offices of Brian S. Steinberger, PA

(57) ABSTRACT

A handicapped accessible work table having a horizontal transparent table top, with removable plant trays, cushioned arm rest edges, and vertical legs with caster wheels. The tabletop is supported by parallel identical one piece aluminum franes. Each frame is formed from bending an aluminum bar at several points. Each side frame has vertical legs that have upper portions that bend to form supports for the table top and an upwardly bent mid-section that passes through a slot in the table top. A cross-brace bar connects the top of the opposite upwardly bent mid-sections of each frame to give the table structural support above the tabletop. Thus, wheelchairs have no obstacles when positioned about and under the edges of the table. An ultraviolet light source can be connected to the cross-brace bar so that plantings in the trays can have an adequate light source for growth when the table is used for gardening. The tabletop can include a solid working surface. The tabletop can be used for home applications such as laundry. kitchen and food preparation.

20 Claims, 4 Drawing Sheets

GARDEN TABLE

This invention relates to tables, and in particular to a handicapped accessible garden work table for wheelchair users, and the invention claims the benefit of priority to U.S. Provisional Application Serial No. 60/200,616 filed Apr. 28, 2000.

BACKGROUND AND PRIOR ART

Handicapped persons especially wheelchair occupants often have difficulty with traditional and conventional furniture when used as worktables. For example, stationary work tables are usually too heavy to move for a persons in a wheelchair. Most work tables have obstacles under the tables such as structural support cross-braces, thick legs, low tops, and the like that restrict the wheelchairs accessibility to fit underneath the tables.

The traditional work tables have hard surface areas especially adjacent to the outer edges of the table that are both uncomfortable to users. Additionally, plane hard upper edges on tables offer no additional support to handicapped persons having coordination difficulties and weak muscularity in their arms.

Traditional work tables have no built on light sources so that users must either physically place lamps on the table and/or rely on floor lamps and/or overhead light sources. Additionally. traditional work tables within darkened rooms cannot rely on these traditional non ultraviolet light sources for growing plants.

The inventors are aware of several United States Patents of interest. See for example, U.S. Pat. No. 3,606,450 to Sedgwich; U.S. Pat. No. 4,054,315 to Czarnowski; U.S. Pat. No. 4,440,096 to Rice et al.; U.S. Pat. No. 5,369,805 to Bergsten et al.; U.S. Pat. No. 5,399,009 to Hiner; U.S. Pat. No. 5,421,270 to Kelly; and U.S. Pat. No. 5,876,262 to Kelly et al. However, none of these patents overcome all the problems described above.

SUMMARY OF THE INVENTION

The first objective of the present invention is to provide a handicapped accessible table, geared toward the physically challenged, and capable of growing small, simple plants.

The second object of this invention is to provide a high quality, reasonably priced handicapped accessible table that gives enjoyment, satisfaction and fulfillment to the user.

The third object of this invention is to provide a handicapped accessible table that is free standing, easy to use, lightweight, strong, and rustproof.

The fourth object of this invention is to provide a handicapped accessible table that can allow for four or more wheelchairs to be able to fit underneath the table simultaneously.

The fifth object of this invention is to provide a handicapped accessible table having armrests that provide support and comfort to users having both coordination difficulties and weak muscularity in their arms.

The sixth object of this invention is to provide a handicapped accessible table that is mobile and not staticly positioned.

The seventh object of this invention is to provide a handicapped accessible table using artificial light sources such as ultraviolet, for both a light source to the user and for plants.

The eighth object of this invention is to provide a handicapped accessible table having a transparent surface for allowing the user to see below the table, and transparent storage compartments for allowing the user to see plants beneath a dirt surface.

The ninth object of this invention is to provide a handicapped accessible table where structural cross-braces for the table are above the table surface.

The tenth object of this invention is to provide a handicapped accessible table to be used for gardening.

The eleventh object of this invention is to provide a handicapped accessible table that can be used as a laboratory table.

The twelfth object of this invention is to provide a handicapped accessible table that can be used for home applications such as laundry, kitchen and food preparation.

A preferred embodiment of the handicapped accessible table for gardening includes a rectangular table top, a first support leg frame for supporting a first side of the table top above ground level, a second support frame parallel to the first support frame for supporting a second side of the table top above the ground level opposite to the first side, and a cross-brace above the table top that is connected to a first raised portion of the first support frame, and to a second raised portion of the second support leg frame, wherein there are no obstacles underneath the gardening table to restrict wheelchair accessibility.

Each of the first support leg frame and the second support leg frame are formed from a single metal bar such as aluminum bent at selected portion. Each of the single metal bars has vertical leg portions that can have wheels that are connected to upper edge portions for supporting the table top and an upwardly raised mid-portion that passes through the table top, wherein the cross-brace is attached to the upwardly raised mid-portion.

The table top has a transparent surface with side slots for allowing the first raised portion and the second raised portion to pass therethrough. The table top further includes slots where raised edges of removable trays are held within. The tabletop has cushioned armrests. The tabletop can also be used without slots as a solid surface.

The invention can be used as a laboratory table, a home type utility table for laundry, kitchen and food preparation, and the like.

Further objects and advantages of this invention will be apparent from the following detailed description of a presently preferred embodiment which is illustrated schematically in the accompanying drawings.

DESCRIPTION OF THE PREFERRED EMBODIMENT

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

Figure 1A:
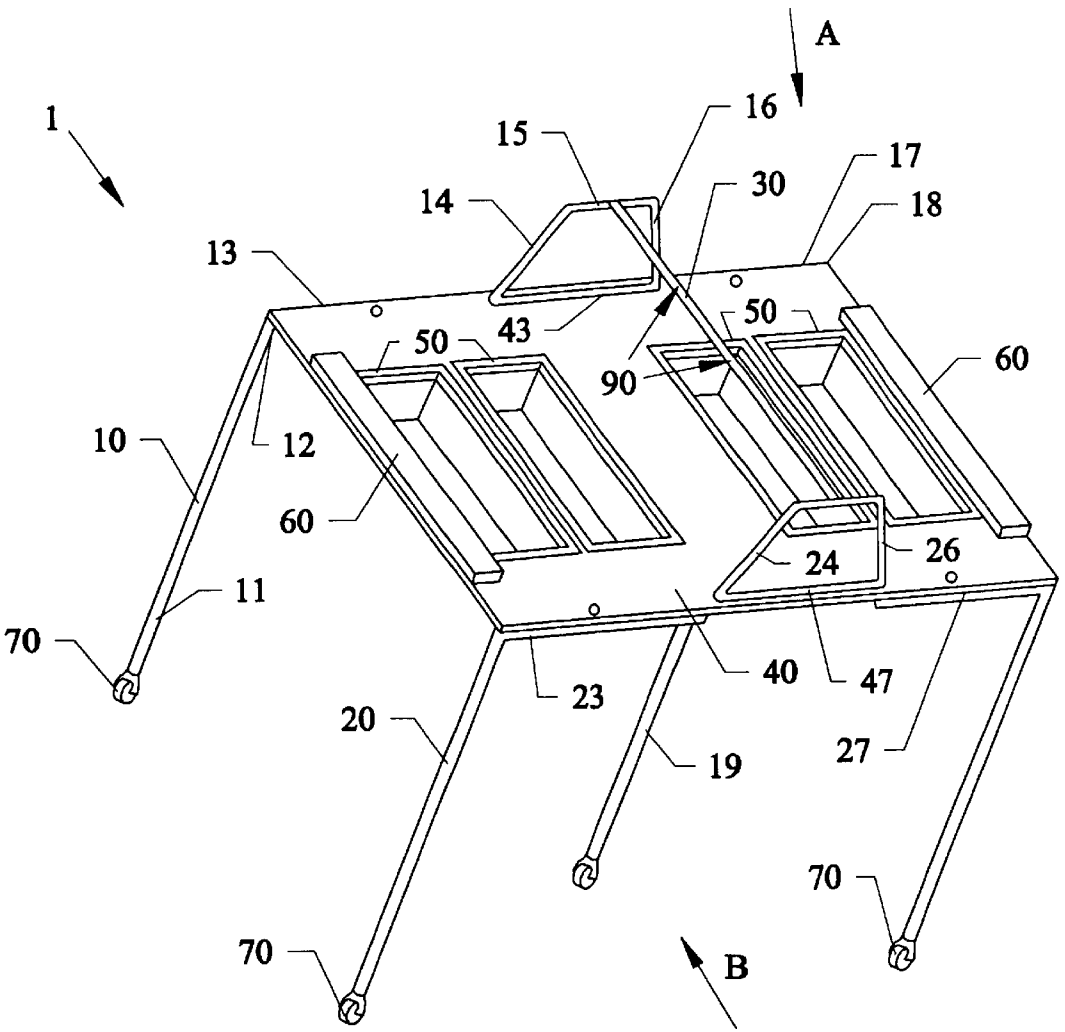
FIG. 1A is a perspective view of a preferred handicapped accessible gardening table invention.
Figure 1B:
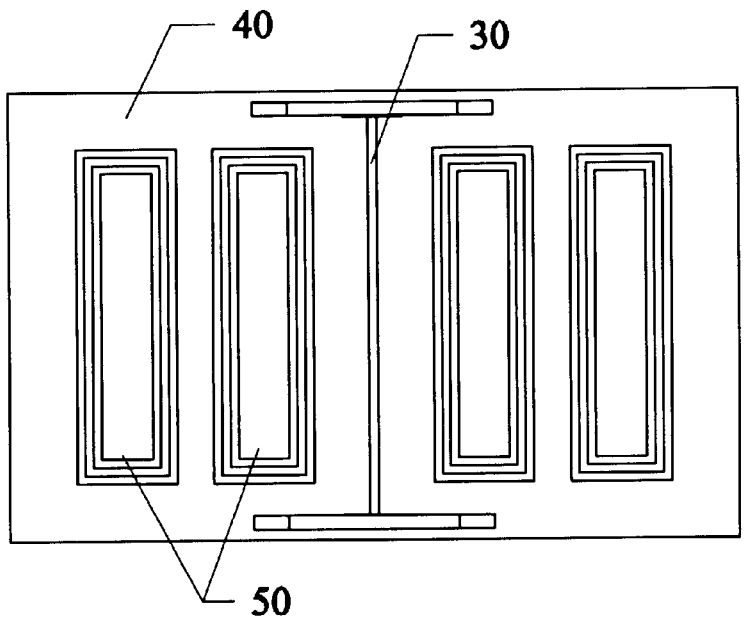
FIG. 1B is a top view of the table of FIG. 1A along arrow A.
Figure 1C:
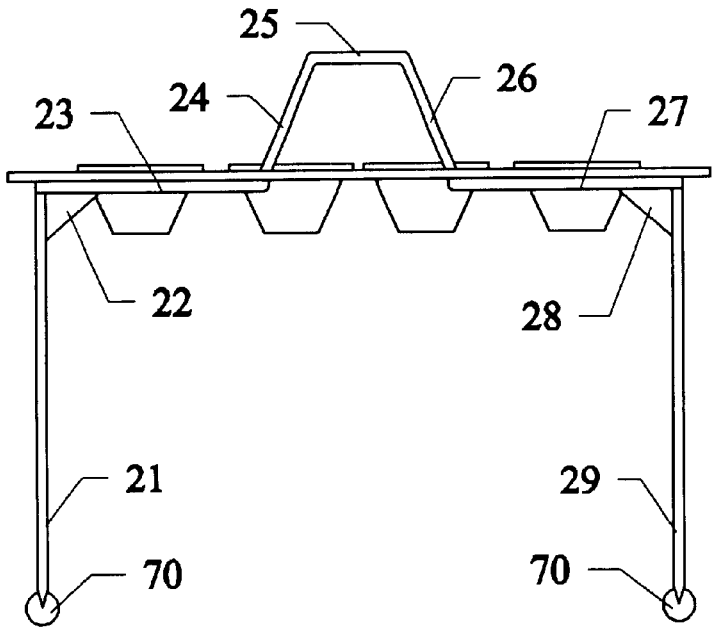
FIG. 1C is a side view of the table of FIG. 1A along arrow B.
Figure 2:
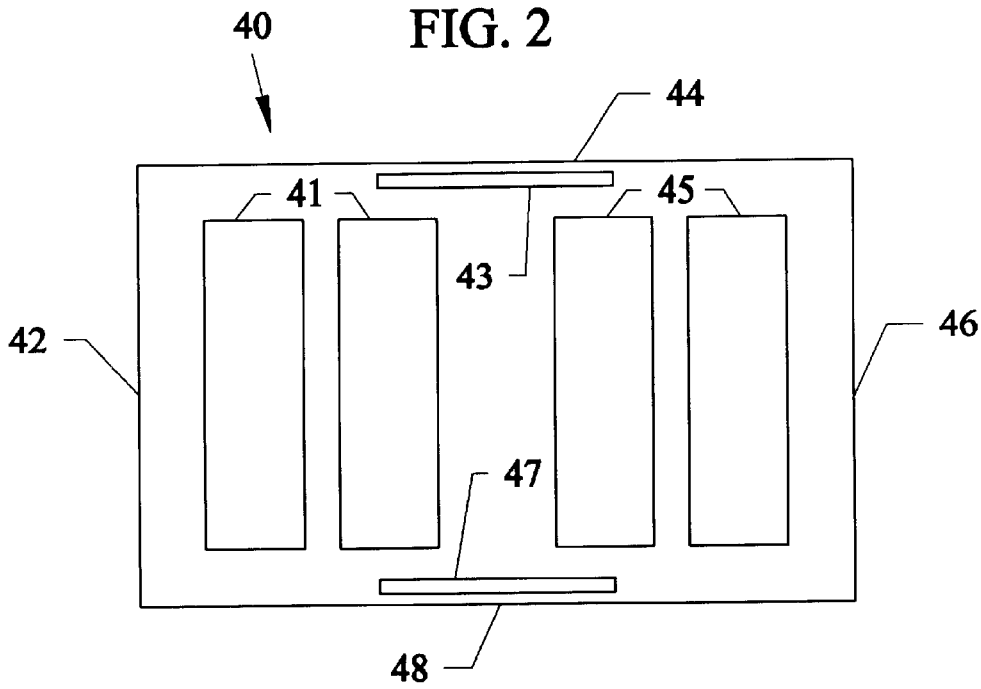
FIG. 2 is a separate top view of the tabletop of FIGS. 1A–1C.
Figure 3:
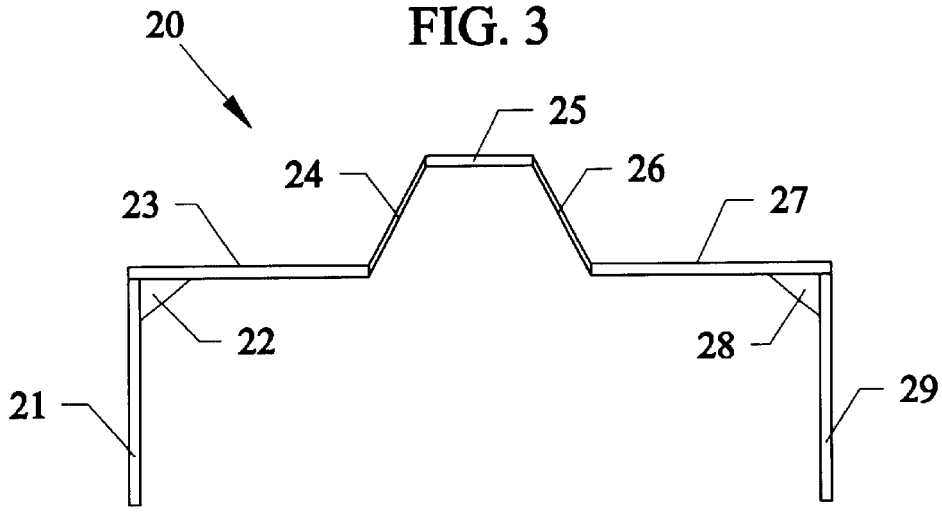
FIG. 3 is a side view of one of the frame legs of FIGS. 1A–1C.
Figure 4B:
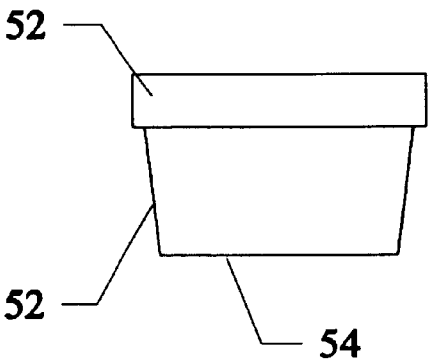
FIG. 4B is an end view of the removable tray of FIG. 4A along arrow C.
Figure 4A:
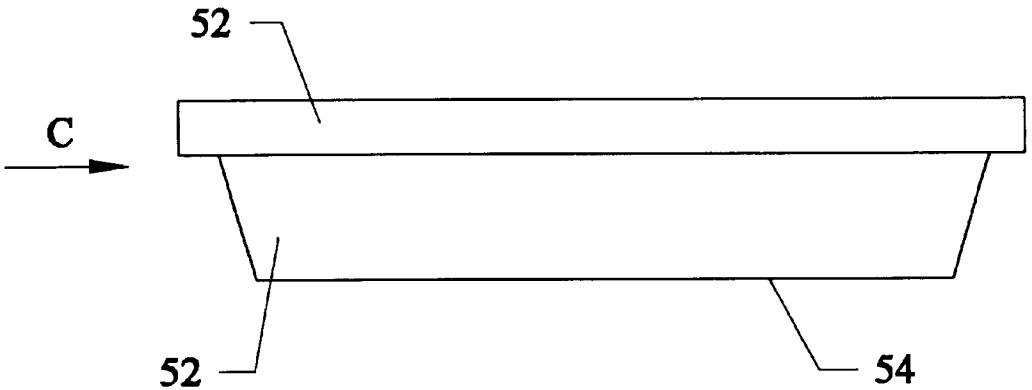
FIG 4A is a side view of one of the removable trays of FIGS. 1A–1C.

FIG. 1A is a perspective view of a preferred handicapped accessible gardening table invention 1. FIG. 1B is a top view of the table 1 of FIG. 1A along arrow A. FIG. 1C is a side view of the table 1 of FIG. 1A along arrow B. FIG. 2 is a separate top view of the tabletop 40 of FIGS. 1A–1C. FIG.3 is a side view of one of the frame support legs 20 of FIGS. 1A–1C. FIG. 4A is a side view of one of the removable trays 50 of FIGS. 1A–1C. FIG. 4B is an end view of the removable tray 50 of FIG. 4A along arrow C.

Referring to FIGS. 1A–4B, table 1 includes a first support leg frame 10, and an identical second support leg frame 20. that can be made of strong, lightweight materials such as aluminum, and the like. For purposes of brevity only second support leg frame 20 will be described. Second support leg frame includes vertical leg portions 21, 29 each having a lower end that can include a wheel 70 thereon to allow the table 1 to be easily moveable. Wheels 70 can include brakes to lock the table in place to prevent movement. The upper end of vertical leg portions 21, 29 include an angled comer bracket 22, 28, that can attach vertical leg portions 21, 29 to horizontal tabletop support members 23, 27, by known techniques such as welding, soldering, and the like. Inside ends of horizontal members 23, 27 are attached to upwardly and inwardly angled raised members 24 and 26 which are connected to one another by raised horizontal mid-member 25. First support leg frame 10 has identical components to that of second support leg frame 20.

Tabletop 40 includes two short sides 42, 46, and two long sides 44, 48, with two longitudinal slots 43, 47 along a mid-portion of long sides 44, 48 for allowing upwardly raised members 14–16 of first support leg frame 10, and upwardly raised members 24–26 of second support leg frame 20 to pass therethrough. The horizontal members 13, 17, 23, 27 of the first and second support leg frames 10, 20 act as support edges for supporting the undersurface of tabletop 40 above the floor. Bar 30 is then attached to a mid-portion of upper horizontal members 15, 25 by such techniques as welding, and the like, to function as the main cross-brace support for the table 1. Thus, there are no cross-braces below the table 1 itself. Other than the vertical leg portions 11, 19, 21, 29, there are no obstructions which would prevent a wheelchair from being able to have a seat portion which comes under the tabletop 40.

On at least both short side ends 42, 46, there can be rectangular armrest pads 60 for protecting the forearms and/or elbows of persons seated along the table 1. The armrest pads can include a vinyl outer surface about a foam pad inside, where the outer surface can be fastened to the table top 40 by glue, screw fasteners, and the like.

Tabletop 40 of table 1 further includes rectangular slots 41, 45 for allowing removable trays 50 to be supported therein. Although only four slots 41, 45 are shown, the invention can be practiced with more or less slots for the removable trays.

Each of the removable insert trays 50 includes an upper raised rectangular edge 52, inwardly sloped sides 52 and a closed bottom 54. The raised edge 52 supports the trays 50 within the slots 50. The storage trays 50 can be used for plants, soil and fertilizer, seeds, and tools.

Attached to cross-brace bar 30 can be light sources 90, such as but not limited to ultraviolet light sources, and the like, that can be connected thereon.

Additionally, the tabletop can also be used without slots as a solid work surface.

In addition to garden applications, the invention can be used as a laboratory table, a home type utility table for laundry, kitchen and food preparation, and the like.

While the invention has been described, disclosed, illustrated and shown in various terms of certain embodiments or modifications which it has presumed in practice, the scope of the invention is not intended to be, nor should it be deemed to be, limited thereby and such other. modifications or embodiments as may be suggested by the teachings herein are particularly reserved especially as they fall within the breadth and scope of the claims here appended.

We claim:

1. A handicapped accessible table, comprising in combination:

a table top;

a first support frame for supporting a first side of the table top above ground level;

a second support frame parallel to the first support frame for supporting a second side of the table top above the ground level opposite to the first side, wherein each of the first support frame and the second support frame include vertical leg portions connected to upper edge portions for supporting the table top and an upwardly raised mid-portion that passes through the table top; and a cross-brace above the tabletop connected to both the upwardly raised mid-portion of the first support frame and to the upwardly raised mid-portion of the second support frame, wherein there are no obstacles other than the vertical leg portions underneath the table to restrict wheelchair accessibility.

2. The handicapped wheelchair accessible table of claim 1, wherein each of the first support leg frame and the second support leg frame are formed from a single metal bar bent at selected portions.

3. The handicapped wheelchair accessible table of claim 2, wherein the single metal bar is formed from aluminum.

4. The handicapped wheelchair accessible table of claim 1, wherein the table top includes:

a transparent surface with side slots for allowing the first raised portion and the second raised portion to pass therethrough.

5. The handicapped wheelchair accessible table of claim 1, wherein the table top includes:

removable trays.

6. The handicapped wheelchair accessible table of claim 1, wherein the table top includes:

cushioned armrest edge portions on the tabletop.

7. The handicapped wheelchair accessible table of claim 1, further comprising:

wheels on each of the first support frame and the second support frame.

8. The handicapped wheelchair accessible table of claim 1, wherein the tabletop includes:

a solid working surface.

9. The handicapped wheelchair accessible table of claim 1, wherein the table is used as:

a garden table.

10. The handicapped wheelchair accessible table of claim 1, wherein the table is used as:

a laboratory table.

11. The handicapped wheelchair accessible table of claim 1, wherein the table is used as:

a laundry and kitchen table.

12. A handicapped accessible table, comprising in combination:

a rectangular table top;

a first support frame bar for supporting a first side of the table top above ground level;

a second support frame bar parallel to the first support frame for supporting a second side of the table top above the ground level opposite to the first side, wherein each of the first support frame bar and the second support frame bar includes vertical leg portions connected to upper edge portions for supporting the table top and an upwardly raised mid-portion that passes through the table top; and a cross-brace bar above the table top that is connected to both the upwardly raised mid-portion of the first support frame bar and the second support frame bar, wherein there are no obstacles other than the vertical leg portions underneath the table to restrict wheelchair accessibility.

13. The handicapped wheelchair accessible table of claim 12, wherein each of the first support frame bar and the second support frame bar are formed from a single metal bar bent at selected portions.

14. The handicapped wheelchair accessible table of claim 13, wherein the single metal bar is formed from aluminum.

15. The handicapped wheelchair accessible table of claim 12, wherein the table top includes:

a transparent surface.

16. The handicapped wheelchair accessible table of claim 12, wherein the table top includes:

removable trays.

17. The handicapped wheelchair accessible table of claim 12, wherein the table top includes:

cushioned armrest edge portions on the tabletop.

18. The handicapped wheelchair accessible table of claim 12, further comprising:

wheels on each of the first support frame and the second support frame.

19. A work table, comprising in combination:

a horizontal table top having a first end and a second end opposite the first end;

a first pair of legs for supporting the first end of the table top above a surface;

a second pair of legs parallel to the first pair of legs for supporting the second end of the table top above the surface;

a first horizontal member having ends connected to each the first pair of legs and being adjacent to a side edge on the first end of the table;

a second horizontal member having ends connected to each of the second pair of legs and being adjacent to a side edge on the second end of the table;

a first raised portion connected to a mid portion along the first horizontal member, the first raised portion extending above the table top;

a second raised portion connected to a mid-portion along the second horizontal member, the second raised portion extending above the table top; and a cross-brace member above the table top connected to both the first raised portion and the second raised portion, wherein there are no obstacles other than the first pair of legs and the second pair of legs underneath the table.

20. The table of claim 19, wherein the first horizontal member and the second horizontal member each wrap about opposite side edges of the table top.

* * * * *